US005098094A

United States Patent [19]

Kita

[11] Patent Number: 5,098,094

[45] Date of Patent: Mar. 24, 1992

[54] TETHERED BALL PRACTICE APPARATUS

[76] Inventor: Shigeru Kita, 2-2-3 Showa-cho, Abeno-ku, Osaka, Japan

[21] Appl. No.: 577,700

[22] Filed: Sep. 4, 1990

[51] Int. Cl.[5] ..... A63B 69/40

[52] U.S. Cl. ..... 273/29 A; 273/58 C; 273/26 E; 273/26 EA; 273/413

[58] Field of Search ..... 273/26 EA, 29 A, 196, 273/197, 199, 200 R, 200 A, 58 C, 413

[56] References Cited

U.S. PATENT DOCUMENTS

| | | | |
|---|---|---|---|
| 3,194,557 | 7/1965 | Holley | 273/200 |
| 3,521,887 | 7/1970 | Butkus | 273/200 |
| 3,593,998 | 7/1971 | Ballyn | 273/58 C |
| 3,630,521 | 12/1971 | Lingbeek | 273/26 EA |
| 3,703,286 | 11/1972 | Adkin | 273/26 EA |
| 3,804,409 | 4/1974 | Schachner | 273/580 |
| 3,839,300 | 6/1958 | Blaha et al. | 273/200 |
| 3,953,028 | 4/1976 | Gowins | 273/26 EA |
| 4,093,234 | 6/1978 | Barton | 273/200 |
| 4,342,459 | 8/1982 | Pretorius | 273/26 EA |
| 4,902,012 | 2/1990 | Kita | 273/29 A |

*Primary Examiner*—Theatrice Brown

*Attorney, Agent, or Firm*—Gifford, Groh, Sprinkle, Patmore and Anderson

[57] ABSTRACT

A ball game practice apparatus having a ball, a ground support member and elastic means attached to the ground support member for limiting a traveling distance of the ball. The elastic means further includes a frame connecting portion fixed to the frame and a ball connecting portion connected at one end to the frame connecting portion and fixed at the other end to the ball. The ball connecting portion includes at least two respective pluralities of strings grouped in separate portions, the elasticity of the portions being different due to the member of strings in on group being different from the number of strings in the other group.

4 Claims, 2 Drawing Sheets

TETHERED BALL PRACTICE APPARATUS

BACKGROUND OF THE INVENTION

1. Field of the Invention

The present invention relates to a ball game practice apparatus, particularly comprising a ball and a fly limiting device restricting a flying distance of the ball by means of an elastic expanding member and having a frame fixedly supporting the elastic expanding member, in which the elastic expanding member includes a frame fixing portion fixed to the frame and a ball fixing portion connected at one end to the frame fixing portion and secured at the other end to the ball.

2. Description of the Prior Art

The conventional ball game practice apparatus of this type, e.g. the tennis practice apparatus, generally employ rubber as elastic expanding means.

The practice is carried out by repeating actions of hitting the ball fixed to the one end of the elastic expanding member to make it fly forwardly under an expanding force of rubber as the elastic expanding member, and then hitting the bounded ball again which has dropped in the floor under a contracting force of rubber. A front rebounding board arranged forwardly of a ball flying direction is sometimes utilized with this apparatus to rebound the ball from this board.

However, the conventional apparatus utilize uncoated rubber, whether it is natural rubber or synthetic rubber. As a result, expanding and contracting operations rely only upon an elastic force of rubber, which reflects unevenness of rubber per se. More particularly, since the expanding or contracting force of rubber is suddenly decreased, or unnecessarily increased after hitting the ball to cause the ball to fly in a direction away from a hitting position of the player, it is often occurred that the ball does not reliably return to adjacent the player's position. That is, conditions of a returned ball is not good. Therefore, it is difficult for the player to repeat or continue hitting actions. In addition, rubber itself does not have a sufficient durability.

In order to solve the above-noted problems, the present invention aims at providing a ball game practice apparatus in which a ball hit by the player can reliably return to adjacent the player's position to continuously enjoy the ball hitting practice.

SUMMARY OF THE INVENTION

In order to achieve the above object, the present invention is characterized by a ball game practice apparatus comprising a ball, and a fly limiting member including an elastic expanding member for limiting a flying distance of the ball and a frame for fixedly supporting the elastic expanding member wherein the elastic expanding member includes a frame fixing portion fixed to the frame, and a ball fixing portion connected at one end to the frame fixing portion and fixed at the other end to the ball, at least the ball fixing portion consisting of different binding combinations of more than one coated string, each having a rubber string as a core.

Moreover, it is preferable that the frame of the fly limiting member is positionally maintained in the air, that the frame fixing portion of the elastic expanding member is fixed to the frame so as to extend substantially along a flying direction of the ball, and that the ball fixing portion is adapted to suspend the ball in the air.

It is also desirable that a downward displacement regulating member is mounted on the frame between a fixing end for fixing the frame fixing portion of the elastic expanding member to the frame and a connecting portion for connecting the frame fixing portion to the ball fixing portion, for restricting downward movement of the frame fixing portion of the elastic expanding member.

It is advantageous that the apparatus includes a front rebounding board arranged in a forward position in the ball flying direction so as to rebound the ball hit by the player.

It is further advantageous that the apparatus includes a floor rebounding board arranged in the floor for rebounding the once dropped and bounded ball.

Operations and effects according to the present invention will be set forth below.

With the structure of the subject apparatus as described above, when the elastic expanding member of the ball fixing portion connected directly to the ball is expanded with a flying ball, fibers coating the rubber strings function to restrict the expansion of the rubber strings to properly control the ball flying distance before the core rubber string is fully stretched, which amounts to a good flying condition removing the property of unevenness of the rubber strings. A smaller number of rubber strings is limited so as not to expand too much by a larger number of rubber strings. Thus, the combination of the smaller number of rubber strings and larger number of rubber strings controls an expanding degree of the strings to properly extend the ball flying distance.

On the contrary, when the ball fixing portion is contracted, the structure of the different combinations of the bound coated strings allows the ball to return relatively strongly when lightly hit and to return relatively lightly when strongly hit. As a result, the ball does not return to such positions as exceedingly away from the initial position, but reliably return to adjacent the initial position with an adequate speed, not too fast and not too slow. In other words, since the expanding degree of the coated strings is properly controlled whether the ball is hit strongly or lightly, a range within which the ball drops is not excessively enlarged to guarantee a fairly good condition of the returned ball free of unevenness.

Furthermore, the lifetime of the rubber strings is remarkably extended.

Since the frame of the fly limiting member is positionally maintained in the air, and the frame fixing portion of the elastic expanding member is fixed to the frame substantially along the ball flying direction, and also the ball fixing portion is adapted to suspend the ball in the air, the present apparatus is advantageous when utilized as a tennis practice apparatus because the ball does not roll down the floor or the ground.

Since the downward displacement regulating member is mounted on the frame between the fixing end for fixing the frame fixing portion of the elastic expanding member to the frame and the connecting portion for connecting the frame fixing portion to the ball fixing portion, for restricting downward movement of the frame fixing portion of the elastic expanding member, a downward displacement of the elastic expanding member at a ball suspending position is relatively diminished even if an expanding amount of the elastic member is increased by strongly hitting the ball. Thus, it is not necessary to increase the whole practice apparatus in size, specifically a height, which prevents a heightened level of the fixing position of elastic expanding member to the frame. This facilitates the hit ball to return to adjacent the initial suspending position to easily repeat the hitting practice.

The front rebounding board arranged in the forward position in the ball flying direction so as to rebound the ball hit by the player permits the player to utilize a rebounding force exerted from the rebounding board thereby to further facilitate the repeated practice and practical exercise.

By providing the floor rebounding board arranged in the floor for rebounding the once dropped and bounded ball, the player can selectively use this board having various rebounding faces and can enjoy a variance of the ball bounded in the ground and returned to adjacent the player's position. This also permits the player to do more practical exercise repeatedly.

DETAILED DESCRIPTION OF THE PREFERRED EMBODIMENTS

Preferred embodiments of a ball game practice apparatus for use, e.g. as a tennis practice apparatus will be particularly described below with reference to the accompanying drawings.

Figure 1:
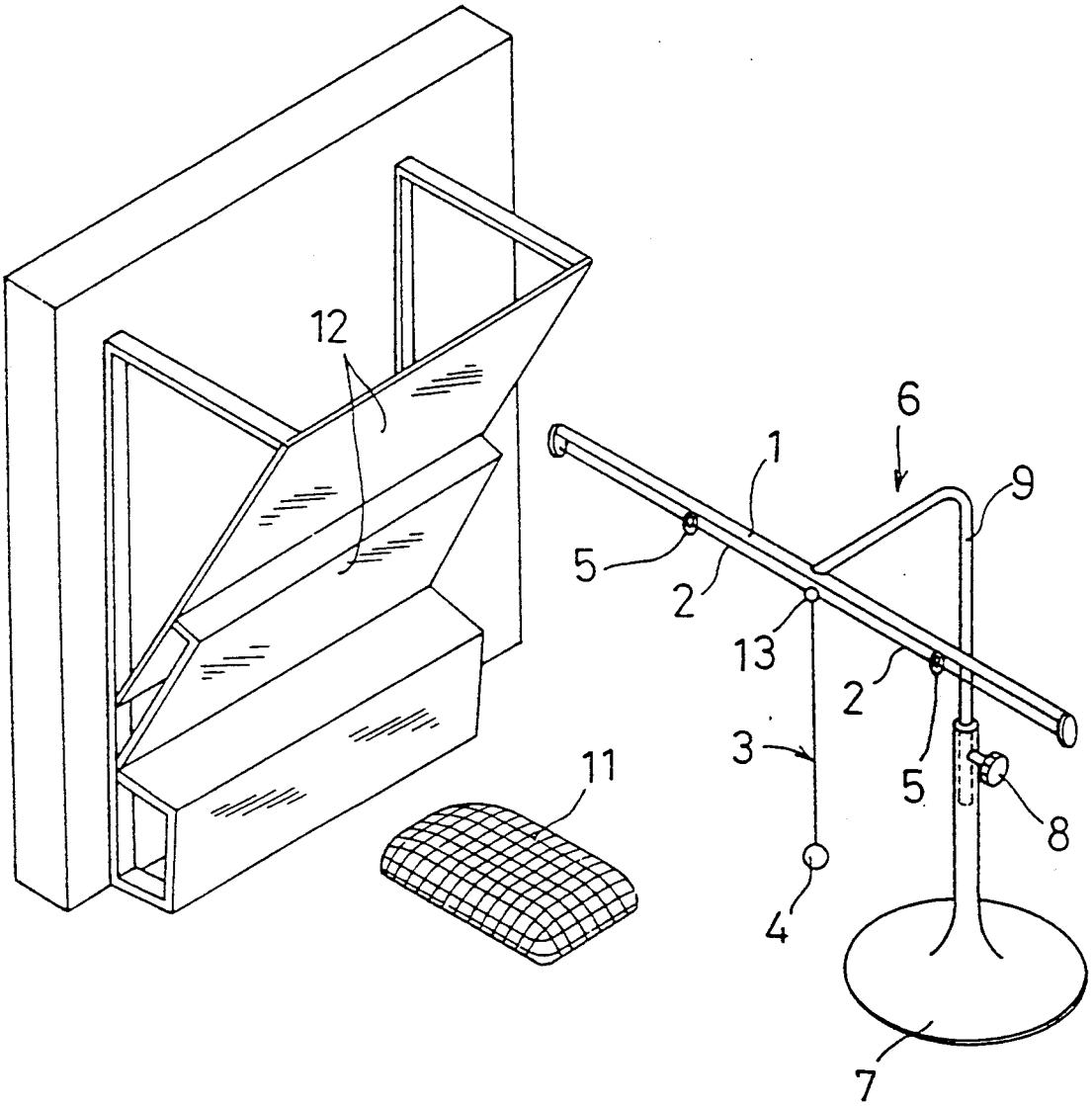
FIG. 1 is a perspective view of a ball game practice apparatus according to the present invention.
Figure 2:
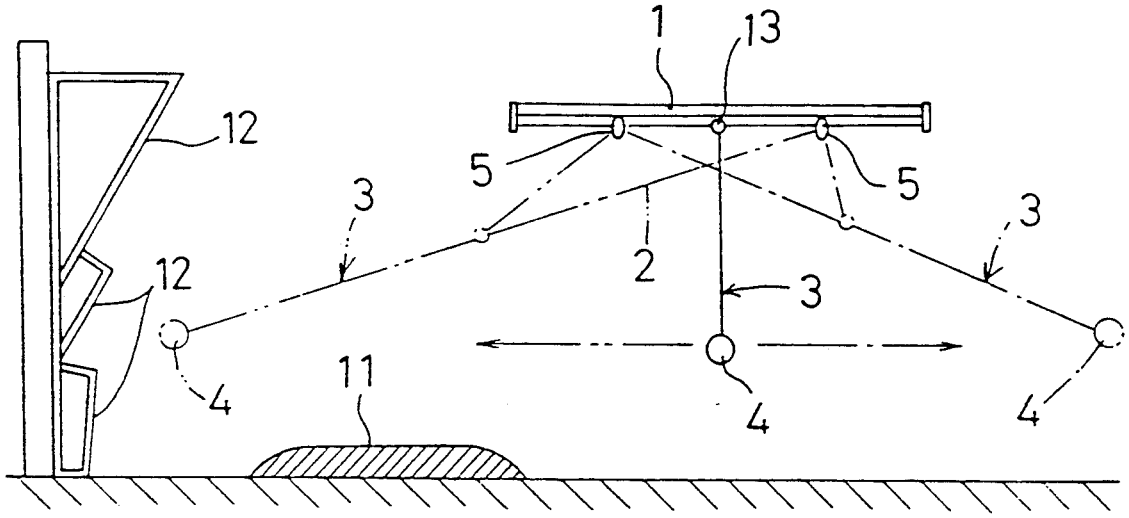
FIG. 2 is a diagrammatic side view of the apparatus.
Figure 3:
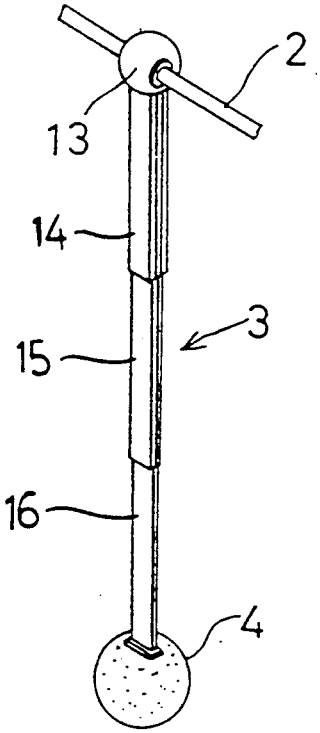
FIG. 3 is an enlarged view of a ball fixing portion of an elastic expanding member.

FIGS. 1 and 2 illustrate a basic construction of the ball game practice apparatus, respectively, and FIG. 3 shows an enlarged construction of an elastic expanding ball fixing portion 3.

The ball game practice apparatus according to the present invention comprises a ground support member 6 as a fly limiting member for suspending and positioning a ball 4 in a fixed position, a front rebounding board 12 for rebounding the hit ball 4 toward the player, and a floor rebounding board 11 for varying the angle of the ball once dropped on the floor and then rebounding the ball again.

The ground support member 6 supports a frame 1 in a fore and aft direction and includes an L-shaped post 9 fixed at an end to a substantial center of the frame 1, and a setting leg 7 on which a weight may be placed. The setting leg 7 has a pipe-shaped upper portion into which the L-shaped post 9 is vertically slidably inserted at a lower end thereof so as to position a level of the L-shaped post 9 by a fixing member 8.

The frame 1 is constructed as a pipe and fixes an elastic expanding member at opposite ends thereof. The elastic expanding member consists of a frame connecting portion 2 and a ball fixing portion 3 interconnected by a detachable connecting member 13. Downward movement of the elastic expanding portion 2 parallel to the frame 1 is restricted through a pair of ring-shaped downward displacement regulating members 5 each attached to the frame 1 in an intermediate portion between a fixing portion to the frame 1 and the connecting member 13.

As shown in FIG. 3, the elastic ball fixing portion 3 comprises a first flattened rubber tape portion 14 including thirty six coated strings bound one above the other and connected to the connecting member 13, a second flattened rubber tape portion 15 including twenty four coated strings bound one above the other and connected to a lower end of the first flattened rubber tape portion, and a third flattened rubber tape portion 16 including twelve coated strings bound one above the other and connected to a lower end of the second flattened rubber tape portion. The ball 4 is suspended from a distal end of the last flattened rubber tape portion. Owing to these combinations of the coated strings forming the elastic ball fixing member 3, the expansion of the elastic member is limited within a constant range under a restricting force of fibers coating the rubber strings before a core rubber string is fully stretched. In addition, since the construction of the bound coated strings in each portion is different to the others, the expanding force and the contracting force properly balance with each other, which results in a stable rebounding ball to return to adjacent a hitting position of the player. This allows the player to repeat and continue the hitting practice.

The construction of the bound coated strings may include various combinations. The different combinations among the respective tape portions of more than one string are sufficient.

The front rebounding board 12 includes a plurality of rebounding faces to provide a rebounding ball with a variance. By varying the angles of the plurality of rebounding faces or by varying the number of the rebounding faces, a great variety of rebounding conditions can be realized.

In FIGS. 1 and 2, one front rebounding board 12 is provided in a ball flying direction, but may be complemented by another type of rebounding boards provided in lateral opposite sides of the front board 12. The complemented boards may be utilized in various combinations.

The floor rebounding board 11 is dispensable. However, the provision of such board is advantageous when repeating the practice in that gentle inclinations of the floor rebounding board 11 in longitudinal and width directions as shown in FIGS. 1 and 2 can provide a greater variety of practical rebounding conditions. This floor rebounding board may also include combinations of a plurality of faces.

The floor rebounding board 11 may consist of various materials having different rebounding forces or varied concave and convex faces.

The rebounding boards as described above may be selectively angularly variable. For instance, each rebounding board includes an electric motor attached thereto for varying a posture of each board by a remote controller. In this connection, the rebounding angles may be previously calculated by means of a computer, according to which the rebounding face of the board is controlled to be able to select any one of rebounding positions of the ball.

The foregoing embodiments employ the ground support member 6 as the fly limiting member which is upright from the ground. However, this member may be replaced by other types of members, e.g. for fixing the frame to a ceiling, or for laying the frame on the ground.

The apparatus according to the present invention is not limited only to the tennis practice apparatus as above-discussed embodiments, but may be applied to various practice of ball games, e.g. racket ball, squash tennis, table tennis, soccer, and the like.

What is claimed is:

1. A ball game practice apparatus comprising:

a ball;

upstanding a stationary support member:

a substantially horizontally extending frame attached to said support member; and an elongated elastic means for elastically restraining the travel of said ball relative to said frame; said elastic means having first and second longitudinal and sections, said first end section having one of its ends attached to said frame and said second end section having one of its ends attached to said ball, the other end of said first longitudinal sections being connected to the other end of said second longitudinal section by connecting means and each section further being comprised of a plurality of elastic strings, the elasticity of said longitudinal sections being different from each other.

2. A ball game practice apparatus as defined in claim 1 wherein, said frame on said stationary support member is positionally maintained above a ground surface, means connecting said one end of said first section of said elastic means to said frame to thereby allow said ball and elastic means to travel in a direction longitudinally of said frame when said ball is hit in a direction longitudinally of said frame when said ball is hit in said longitudinal direction said ball being suspended above said ground surface.

3. A ball game practice apparatus as defined in claim 2 further including a front rebounding board arranged positioned at one end of said frame so as to rebound said ball hit by a player.

4. A ball game practice apparatus as defined in claim 3 further including a floor rebounding board positioned on said ground surface for rebounding said ball.

* * * * *